United States Patent [19]

Schmid

[11] Patent Number: 4,969,237

[45] Date of Patent: Nov. 13, 1990

[54] CLEANING MACHINE FOR TEXTILE FIBRES WITH IMPROVED TRANSFER CHAMBER ARRANGEMENT

[75] Inventor: René Schmid, Niederneunforn, Switzerland

[73] Assignee: Maschinenfabrik Rieter AG, Winterthur, Switzerland

[21] Appl. No.: 472,799

[22] Filed: Jan. 31, 1990

[30] Foreign Application Priority Data

Jan. 31, 1989 [CH] Switzerland ..... 319/89

[51] Int. Cl.[5] ..... D01G 9/08

[52] U.S. Cl. ..... 19/205; 19/200; 19/85

[58] Field of Search ..... 19/24, 39, 50, 59, 85, 19/95, 97.5, 200, 204, 205

[56] References Cited

U.S. PATENT DOCUMENTS

| | | | |
|---|---|---|---|
| 4,102,017 | 7/1978 | Foerster | 19/205 |
| 4,135,276 | 1/1979 | Handschuch et al. | 19/200 |
| 4,479,286 | 10/1984 | Brown et al. | 19/200 |
| 4,637,096 | 1/1987 | Wise et al. | 19/200 |
| 4,736,493 | 4/1988 | Haass-Zöllick et al. | 19/200 |
| 4,797,976 | 1/1989 | Leifeld et al. | 19/200 |
| 4,854,013 | 8/1989 | Pinto et al. | 19/200 |

FOREIGN PATENT DOCUMENTS

| | | | |
|---|---|---|---|
| 266628 | 8/1968 | U.S.S.R. | 19/200 |
| 2000534 | 6/1977 | United Kingdom | 19/85 |
| 2079337 | 1/1982 | United Kingdom | 19/200 |

*Primary Examiner*—Werner H. Schroeder
*Assistant Examiner*—John J. Calvert
*Attorney, Agent, or Firm*—Burns, Doane, Swecker & Mathis

[57] ABSTRACT

A machine for cleaning textile fibres includes a horizontal rotating roller with beater elements and bar grates on the underside of the roller. Delivery air transports the textile fibres in the form of flocks through an inlet which is arranged above the upper side and at one end of the roller. An outlet for the air transporting the fibres is located above the upper side and at the other end of the roller. Between the inlet and the outlet at least three, preferably five transfer chambers are located over the upper side of the roller, each of which lead the air stream passing around the roller axis further in the axial direction of the axis by about the width in the axial direction of the chamber. The transfer chambers are defined by four, preferably six deflectors inclined by an ascending angle with respect to the axis of the roller. The combination of the number of the transfer chambers, the specified ascending angle and the width of the chambers provides an arrangement which can prevent the collection of quantities of fibre and fibre lumps in the transfer chambers.

24 Claims, 1 Drawing Sheet

CLEANING MACHINE FOR TEXTILE FIBRES WITH IMPROVED TRANSFER CHAMBER ARRANGEMENT

FIELD OF THE INVENTION

The invention relates to a cleaning machine for textile fibres conveyed in a current of delivery air, the machine including a horizontal roller fitted with beater elements, bar grates arranged on the underside of the roller, an air inlet for delivery of air and fibres arranged above the upper side and at one end of the roller, an outlet for removal of air and fibres at the other end of the roller, and transfer chambers arranged between the inlet and the outlet and defined by deflector plates which form an acute ascending angle with a plane perpendicular to the axis of the roller, the transfer chambers being further defined by substantially vertical side walls and covering walls extending therebetween, each of the chambers deflecting the delivery air so as to pass around the roller and advance in an axial direction parallel to the roller axis by a distance corresponding approximately to a width in the axial direction between adjacent deflector plates, the covering walls being arranged in the form of terraces and forming an obtuse angle with each other and with the side walls.

BACKGROUND

At least one cleaning machine of the above type is known and on the market. It serves the purpose of opening the flocks in the delivery air and removing the impurities therefrom. With the known machine, however, the opening efficiency and the production in kgs/hr with a given roller size are not always completely satisfactory.

SUMMARY OF THE INVENTION

An object of the invention is to provide a cleaning machine of the above type but which allows the opening effect to be improved and higher productivity to be made possible.

According to the invention, it has been found with the known machine that the already partially opened fibre flocks in the transfer chambers tend to collect in lumps which can be traced back to the guiding of the fibres in the known transfer chamber. The partially opened fibre flocks must be reopened by the roller but there is a risk of "neps" (small knotting of fibres) being formed.

An object of the present invention is to provide a cleaning machine which can avoid the above problem by providing at least four deflector plates which define at least three transfer chambers.

In a preferred embodiment of the invention, four to seven transfer chambers are provided which are defined by five to eight deflector plates. In an especially preferred embodiment of the invention, the machine has five transfer chambers defined by six deflector plates.

According to the invention, it has been found that when the number of transfer chambers is made larger in a conventionally sized machine, the inclined angle formed between the deflector plates and a plane perpendicular to the axis of the roller becomes smaller. Surprisingly, however, as this angle becomes smaller, the tendency for the formation of lumps in the transfer chamber is reduced. The inclined angle selected should not be too small, however, since the risk of a blockage can appear. Suitable angles of inclination lie between 8 and 20°, preferably between 10 and 17°.

In addition, the axial width of the individual transfer chambers also becomes smaller as the number of transfer chambers becomes larger, which counteracts the accumulation of a greater amount of flocks in the transfer chambers. The axial width of the transfer chambers naturally also depends on the length of the roller. If the length of the roller is relatively large, then every transfer chamber can expediently be divided into smaller partial chambers by at least one dividing wall extending through the transfer chamber parallel to the deflector plates. In this way, the flock stream can be divided into smaller partial flock streams during the passage through the transfer chambers.

Also in accordance with the teachings of the present invention, the covering walls and the side walls can form obtuse angles therebetween in the range of from 120 to 140° and the highest of the covering walls can have a clearance from the peripheral area of the roller which is equal to 1/12 to 1/5 of the roller diameter, which, with a specified air passage suited to the machine, brings the advantage of a flock stream guidance of a type with which the flocks are brought against the covering wall with the desired impact, without forming lumps, by means of which the cleaning effect is increased.

BRIEF DESCRIPTION OF THE DRAWINGS

Several embodiments of the invention will now be explained in more detail with reference to the accompanying drawings, in which.

DETAILED DESCRIPTION OF THE PREFERRED EMBODIMENTS

Figure 1:
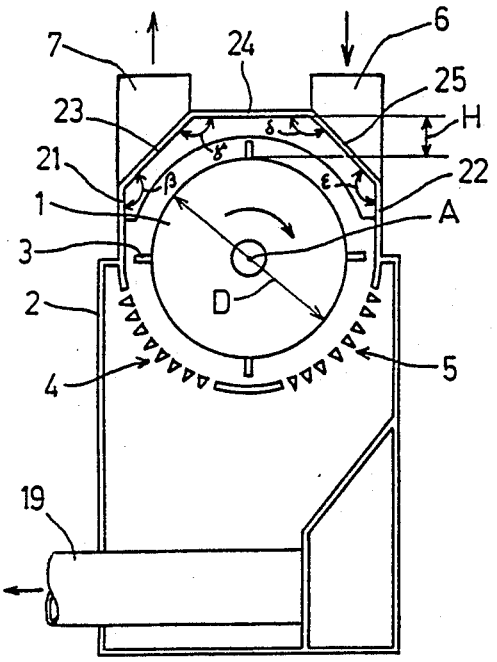
FIG. 1 shows a schematic in a vertical section along the line I—I in FIG. 2 of a cleaning machine according to the invention.
Figure 2:
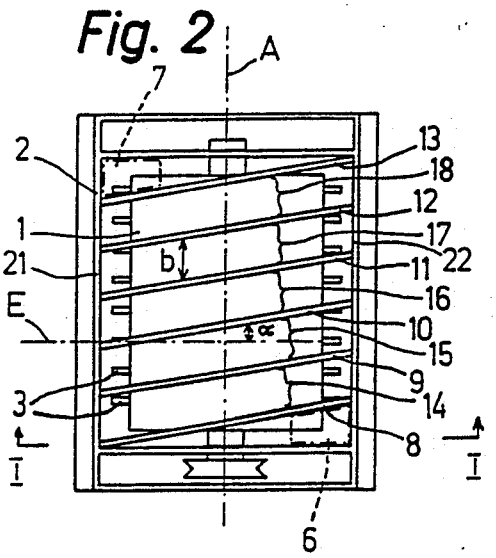
FIG. 2 shows a schematic topview of the cleaning machine according to FIG. 1 without covering walls.

The cleaning machine shown in FIGS. 1 and 2 has a horizontal opening roller 1, which is supported to rotate on its axis A in a casing 2 and the periphery of which is fitted with beater elements 3. In operation, the roller 1 is rotated by a drive motor, not shown, in the direction of the arrow shown in FIG. 1. Two bar grates 4 and 5 are arranged underneath the underside of roller 1. Above the upper side of the roller 1, the casing 2 has an inlet 6 at one end of the roller and an outlet 7 at the other end of the roller.

In FIG. 2, the locations of the inlet 6 and the outlet 7 are not visible but both are indicated by means of a broken line. Six deflector plates 8, 9, 10, 11, 12, 13 are arranged in the casing 2 between the inlet 6 and the outlet 7. The deflectors are oriented such that they are inclined with respect to the axis A of the roller 1 and they form an acute ascending angle alpha with a vertical plane E which is perpendicular to the axis A, as described in the following. Furthermore, the deflector plates can extend rectilinearly and can be parallel to one another.

The six deflector plates define five transfer chambers 14, 15, 16, 17, 18 over the upper side of the roller 1 between the inlet 6 and the outlet 7. Each of the chambers directs the air current further approximately by the length of its own axial width b of 5 to 15 cm in the direction of the axis A.

The transfer chambers 14, 15, 16, 17 and 18 are, in other respects, also defined by the casing walls running parallel to the roller axis A, namely by two approximately vertical sidewalls 21 and 22 and three adjacent covering walls 23, 24 and 25. The covering walls 23, 24, and 25 are arranged as terraces, which means, in the vertical section, they form three sides of an equilateral trapezium and form obtuse angles gamma and delta and beta and epsilon with each other and with the side walls 21 and 22 which amount to 120 to 140°, preferably 135°. The uppermost, approximately horizontal, covering wall 24 is spaced from the peripheral area of the roller 1 by a clearance H which is equal to about 1/12 to 1/5, by preference approximately 1/7, of the diameter D of the roller 1.

In operation, textile fibres in the form of flocks to be cleaned and opened are fed in a delivery air stream to the cleaning machine through the inlet 6. The delivery air with the fibres flows essentially six times around the underside of the roller 1 and in between, subsequently through each of the five transfer chambers 14, 15, 16, 17 and 18 over the upper side of the roller 1, in order to leave the casing finally through the outlet 7. With the movement on the underside of the roller, the fibre flocks are processed and increasingly opened by the beater elements 3 and grates 4 and 5 and impurities are separated from the fibres through the grates 4 and 5 and then removed through a suction outlet 19. Subsequently, the fibres are flung upwards into a succeeding transfer chamber.

Through the suitable selection of the ascending angle alpha, of the width b and the number of transfer chambers in the areas given in this explanation, accumulation of fibres and fibre lumps are largely avoided in the transfer chambers. If, as in the known cleaning machine, only three deflectors or two transfer chambers, respectively, are present, then the flock quantities are too large and accumulate on the inclined walls of the chamber and are then guided again as lumps to the opening roller, which must then start again with the opening almost from the beginning. For this reason, the cleaning machine according to the invention has at least four deflectors or three transfer chambers, respectively, preferably six deflectors and five transfer chambers, as shown in FIG. 2. More than ten deflectors or nine transfer chambers should not be used as a rule, otherwise the angle alpha formed relative to the roller axis by the deflectors, that is, between the deflectors and a line perpendicular to the plane E, can become too small. A small angle alpha was found to be suitable for the avoidance of fibre lump formations, however, the risk of blockages in the transfer chamber exists when the angle alpha is too small. The angle alpha can expediently be between 8 and 20°, preferably between 10 and 17°.

Figure 3:
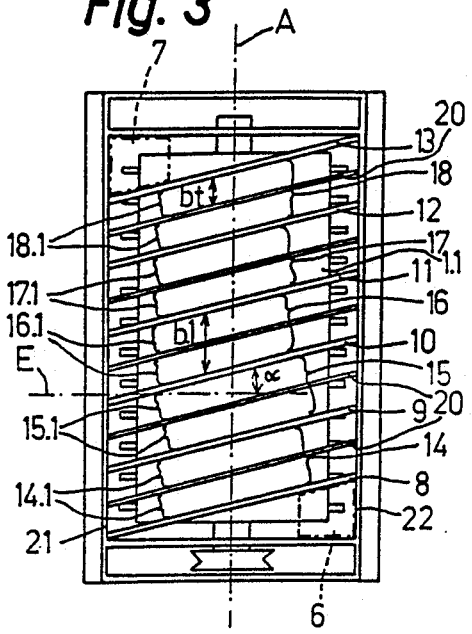
FIG. 3 shows another embodiment of the machine shown in FIG. 2.
Figure 4:
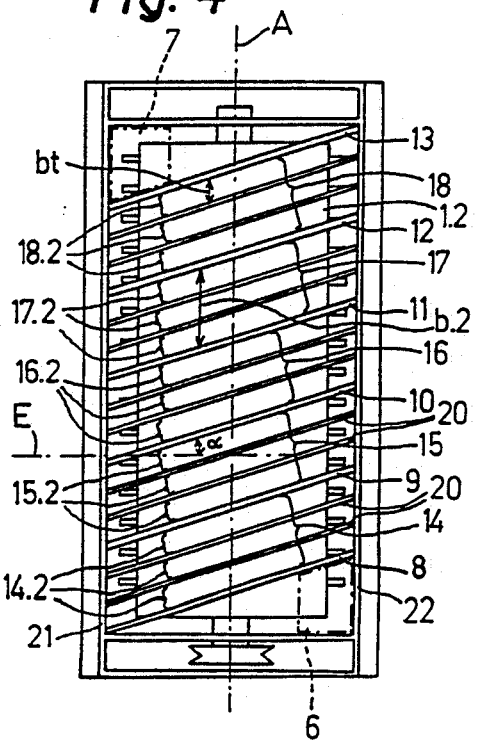
FIG. 4 shows a further embodiment of the machine shown in FIG. 2.

FIGS. 3 and 4 each show a cleaning machine in a view similar to FIG. 2 in which the roller 1.1 or 1.2, respectively, is longer than the roller 1 in FIG. 2. The cleaning machines according to FIGS. 3 and 4 again have six deflectors 8, 9, 10, 11, 12, 13, which define five transfer chambers, 14, 15, 16, 17, 18. Through the greater length of the roller 1.1 or 1.2, the angle of inclination alpha is also correspondingly larger, its size still lying in the range previously mentioned (8 to 20°, preferably 10 to 17°). At the same time, through the greater length of the roller 1.1 or 1.2, the axial width b1 and b2, respectively, of every transfer chamber 14, 15, 16, 17, 18 in FIGS. 3 and 4 is also greater. For this reason, in FIG. 3, every transfer chamber is divided by a subdividing wall parallel to the deflectors into two partial transfer chambers 14.1, 15.1, 16.1, 17.1 and 18.1. The axial width bt of every partial chamber is only half as large as the axial width b1 of the transfer chambers.

In FIG. 4 every transfer chamber is subdivided into three partial chambers by two subdividing walls 20 parallel to the deflectors, the axial width bt of the partial chambers being only approximately equal to one third of the width b2 of the transfer chamber. The width of the partial chamber should not be greater than about 15 cm, for instance, it can expediently amount to 5 to 15 cm. Through the subdivision of the subdividing walls 20, the delivery air stream or the flock stream can be subdivided into smaller streams in every transfer chamber, whereby the risk of the formation of fibre lumps is correspondingly reduced. The opening of a lump which is twice as large involves more than twice the difficulties, because the interlacing in the larger lumps is more intensive.

A further feature of the cleaning machine described, which likewise also makes a contribution, is the fact that the air inlet 6 is so arranged that the incoming delivery air transporting the flocks runs from above to below approximately tangentially to the opening roller 1 in such a way that the air stream, in the position where it meets the circumference of the roller, has the same directional movement as the circumference of the roller 1. The beater elements 3 of the roller 1 should then not move in the opposite direction to the incoming delivery air.

While the invention has been described with reference to the foregoing embodiments, changes and variations may be made thereto which fall within the scope of the appended claims.

What is claimed is:

1. A cleaning machine for textile fibres conveyed in a current of delivery air, the machine comprising a casing, a horizontal roller rotatably supported in the casing and fitted with beater elements, at least one bar grate on the underside of the roller, an inlet for passing a current of delivery air and textile fibres into a space surrounding the roller located at one end of the roller, an outlet located at the other end of the roller, and transfer chambers located between the inlet and the outlet, the transfer chambers being defined by deflector plates which form an acute ascending angle with a plane which is perpendicular to an axis of rotation of the roller, the transfer chambers also being defined by spaced-apart side walls and at least one covering wall therebetween, each of the transfer chambers deflecting the delivery air passing around the roller a distance in an axial direction parallel to the roller axis, the deflector plates comprising at least four deflector plates which define at least three of said transfer chambers.

2. The cleaning machine according to claim 1, wherein said at least three transfer chambers comprise up to nine transfer chambers and said at least four deflector plates comprise up to ten deflector plates.

3. The cleaning machine according to claim 1, wherein said at least three transfer chambers comprise four to seven transfer chambers and said at least four deflector plates comprise five to eight deflector plates.

4. The cleaning machine according to claim 1, wherein the ascending angle formed between the deflector plates and said plane is between about 8 and 20°.

5. The cleaning machine according to claim 1, wherein the distance corresponds to a width of the transfer chambers and is between about 5 and 15 cm.

6. The cleaning machine according to claim 1, wherein at least one of the transfer chambers is subdivided into partial chambers by at least one subdividing wall which is parallel to the deflector plates.

7. The cleaning machine according to claim 6, wherein a width of each of the partial chambers is between about 5 and 15 cm.

8. The cleaning machine according to claim 1, wherein the air inlet is located such that the air introduced therethrough flows somewhat tangentially to a side of the roller which rotates such that the beater elements move in the same direction as the air introduced through the air inlet.

9. The cleaning machine according to claim 8, wherein the air inlet is located such that the air introduced therethrough flows from above to below on the side of the roller.

10. The cleaning machine according to claim 1, wherein the side walls are substantially vertical and the at least one covering wall comprises first, second and third covering walls, the first covering wall being substantially horizontal, the second covering wall extending between one end of the first covering wall and one of the side walls and the third covering wall extending between another end of the first covering wall and the other of the side walls.

11. The cleaning machine according to claim 1, wherein the at least one covering wall is spaced from a peripheral area of the roller by a clearance which is equal to 1/12 to 1/5 a diameter of the roller.

12. The cleaning machine according to claim 1, wherein the distance corresponds approximately to a width in the axial direction between two of the deflector plates which are adjacent to each other.

13. The cleaning machine according to claim 1, wherein the side walls are substantially parallel to the roller axis.

14. The cleaning machine according to claim 10, wherein the first covering wall forms an angle of about 120 to 140° with the second covering wall, the first covering wall forms an angle of about 120 to 140° with the third covering wall, the second covering wall forms an angle of about 120 to 140° with the one side wall and the third covering wall forms an angle of about 120 to 140° with the other side wall.

15. The cleaning machine according to claim 10, wherein the first covering wall forms an obtuse angle with the second covering wall, the first covering wall forms an obtuse angle with the third covering wall, the second covering wall forms an obtuse angle with the one side wall and the third covering wall forms an obtuse angle with the other side wall.

16. The cleaning machine according to claim 1, wherein the at least three transfer chambers comprise five transfer chambers and the at least four deflector plates comprise six deflector plates.

17. The cleaning machine according to claim 4, wherein the ascending angle is in the range of about 10 to 17°.

18. The cleaning machine according to claim 1, wherein each of the transfer chambers is subdivided into partial chambers by at least one subdividing wall which are parallel to the deflector plates.

19. The cleaning machine according to claim 1, wherein each of the transfer chambers is subdivided into partial chambers by at least two subdividing walls which are parallel to the deflector plates.

20. The cleaning machine according to claim 1, wherein the deflector plates extend substantially rectilinearly and are parallel to each other.

21. The cleaning machine according to claim 10, wherein the first covering wall forms an angle of about 135° with the second covering wall, the first covering wall forms an angle of about 135° with the third covering wall, the second covering wall forms an angle of about 135° with the one side wall and the third covering wall forms an angle of about 135° with the other side wall.

22. The cleaning machine according to claim 11, wherein the clearance is equal to about 1/7 of the diameter of the roller.

23. The cleaning machine according to claim 1, wherein each of the deflector plates is located such that one end thereof abuts one of the side walls and an opposite end thereof abuts the other one of the side walls, the one end of a first one of the deflector plates being aligned with the opposite end of a second one of the deflector plates in a direction perpendicular to the roller axis.

24. The cleaning machine according to claim 1, wherein the inlet and the outlet are arranged above an upper side of the roller.

* * * * *